US008057282B2

(12) United States Patent
Muldowney

(10) Patent No.: US 8,057,282 B2
(45) Date of Patent: Nov. 15, 2011

(54) HIGH-RATE POLISHING METHOD

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 582 days.

(21) Appl. No.: 12/317,573

(22) Filed: Dec. 23, 2008

(65) Prior Publication Data

US 2010/0159810 A1 Jun. 24, 2010

(51) Int. Cl.
*B24B 7/22* (2006.01)

(52) U.S. Cl. ..... 451/41; 451/527

(58) Field of Classification Search ..... 451/527, 451/530, 533, 921, 56, 41, 59, 63, 287, 288, 451/526
See application file for complete search history.

(56) References Cited

U.S. PATENT DOCUMENTS 6,843,711 B1 * 1/2005 Muldowney ..... 451/527
7,059,949 B1 * 6/2006 Elmufdi et al. ..... 451/527
7,059,950 B1 * 6/2006 Muldowney ..... 451/527
7,131,895 B2 * 11/2006 Elmufdi et al. ..... 451/103
7,182,677 B2 * 2/2007 Donohue et al. ..... 451/287
7,267,610 B1 * 9/2007 Elmufdi et al. ..... 451/530
7,300,340 B1 * 11/2007 Elmufdi et al. ..... 451/527
7,311,590 B1 * 12/2007 Muldowney et al. ..... 451/526
7,329,174 B2 * 2/2008 Hosaka et al. ..... 451/527
7,520,798 B2 * 4/2009 Muldowney ..... 451/285
2008/0182489 A1 7/2008 Muldowney
2008/0182493 A1 7/2008 Muldowney

* cited by examiner

*Primary Examiner* — Robert Rose
(74) *Attorney, Agent, or Firm* — Blake T. Biederman

(57) ABSTRACT

The invention provides a method for polishing at least one of a magnetic, optical and semiconductor substrate in the presence of a polishing medium with a polishing pad. The substrate is fixed within a carrier fixture having a channel-free surface. The method comprises securing the substrate in the carrier fixture with the channel-free surface adjacent and parallel to a polishing surface of the polishing pad. The polishing pad has multiple grooves with high-rate paths. The method includes applying polishing medium to the polishing pad adjacent the carrier fixture; and rotating the polishing pad and carrier fixture to polish the substrate with the polishing pad and the polishing medium wherein the channel-free surface of the carrier fixture presses against the polishing pad to impede flow of the polishing medium into the substrate and the high-rate groove paths traverse the carrier fixture to promote flow of the polishing medium to the substrate.

10 Claims, 6 Drawing Sheets

HIGH-RATE POLISHING METHOD

BACKGROUND OF THE INVENTION

The present invention generally relates to the field of chemical mechanical polishing (CMP). In particular, the present invention is directed to a CMP process that improves polishing performance.

In the fabrication of integrated circuits and other electronic devices on a semiconductor wafer, multiple layers of conducting, semiconducting and dielectric materials are deposited onto and etched from the wafer. Thin layers of these materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization or adjust polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another. These groove patterns and configurations, however, overlook the utilization of slurry related to CMP polishers having active wafer carrier rings.

Recently, G. P. Muldowney, in US Pat. Pub. No. 2008/0182493, disclosed a low-slurry groove that functions by aligning polishing pad grooves with channels in the carrier ring over a plurality of locations to increase slurry utilization. This patent teaches polishing pad and carrier ring combinations that reduce the squeegee effect at the leading edge of the wafer, wherein much of the film of liquid, e.g., slurry, on the pad texture is swept off by the carrier ring. The patent further states that "The loss of this potentially usable slurry may reduce the effectiveness and predictability of the polishing process, while resulting in significant additional process costs."

While the low-slurry groove pattern of Muldowney increases slurry utilization and reduces the squeegee effect of carrier rings having channels, there remains a need for CMP polishing processes that provide effective removal rate with improved polishing performance when using carrier rings having no channels. Polishing pad designers are continually seeking groove patterns and polishing methods that increase removal rate for increasing tool throughput and facilitate improved polishing performance for increasing wafer yields.

STATEMENT OF THE INVENTION

An aspect of the invention provides a method for polishing at least one of a magnetic, optical and semiconductor substrate in the presence of a polishing medium with a polishing pad, the substrate being fixed within a carrier fixture, the carrier fixture having a channel-free surface, the method comprising: a) securing the substrate in the carrier fixture with the channel-free surface adjacent and parallel to a polishing surface of the polishing pad, the polishing pad having multiple grooves, the multiple grooves having a high-rate path, at least fifty percent of the high-rate path being within twenty percent of a groove trajectory $\phi(r)$ in polar coordinates referenced to a concentric center of the polishing pad and defined in terms of (1) distance R between the concentric center of the polishing pad and the rotational center of the substrate being polished, (2) radius $R_c$ of the carrier fixture, and (3) local angle $\theta_{c0}$ of imaginary grooves in the carrier fixture, as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\,\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ b) applying polishing medium to the polishing pad adjacent the carrier fixture; and c) rotating the polishing pad and carrier fixture to polish the substrate with the polishing pad and the polishing medium wherein the channel-free surface of the carrier fixture presses against the polishing pad to impede flow of the polishing medium into the substrate and the high-rate groove paths traverse the carrier fixture to promote flow of the polishing medium to the substrate.

Another aspect of the invention provides a method for polishing at least one of a magnetic, optical and semiconductor substrate in the presence of a polishing medium with a polishing pad, the substrate being fixed within a carrier fixture, the carrier fixture having a channel-free surface, the method comprising: a) securing the substrate in the carrier fixture with the channel-free surface adjacent and parallel to a polishing surface of the polishing pad, the polishing pad having multiple grooves, the multiple grooves having a high-rate path, at least fifty percent of the high-rate path being within twenty percent of a groove trajectory $\phi(r)$ in polar coordinates referenced to a concentric center of the polishing pad and defined in terms of (1) distance R between the concentric center of the polishing pad and the rotational center of the substrate being polished, (2) radius $R_c$ of the carrier fixture, and (3) local angle $\theta_{c0}$ of imaginary grooves in the carrier fixture, as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ b) applying polishing medium to the polishing pad adjacent the carrier fixture; and c) rotating the polishing pad and carrier fixture in the same direction to polish the substrate with the polishing pad and the polishing medium wherein the channel-free surface of the carrier fixture presses against the polishing pad to impede flow of the polishing medium into the substrate and the high-rate groove paths traverse the carrier fixture to promote flow of the polishing medium to the substrate.

DETAILED DESCRIPTION OF THE INVENTION

It has been discovered that CMP polishing with polishing pads having a plurality of curved-radial grooves in combination with a channel-free carrier ring provides improved polishing performance. In particular, the channel-free carrier ring presses against the polishing pad in a squeegee-like manner to direct slurry through the curved-radial grooves and beneath the carrier ring to the substrate. This limiting of slurry flow to the substrate can provide the unexpected benefit of increasing removal rate in comparison to other pad-carrier ring combinations.

Figure 1:
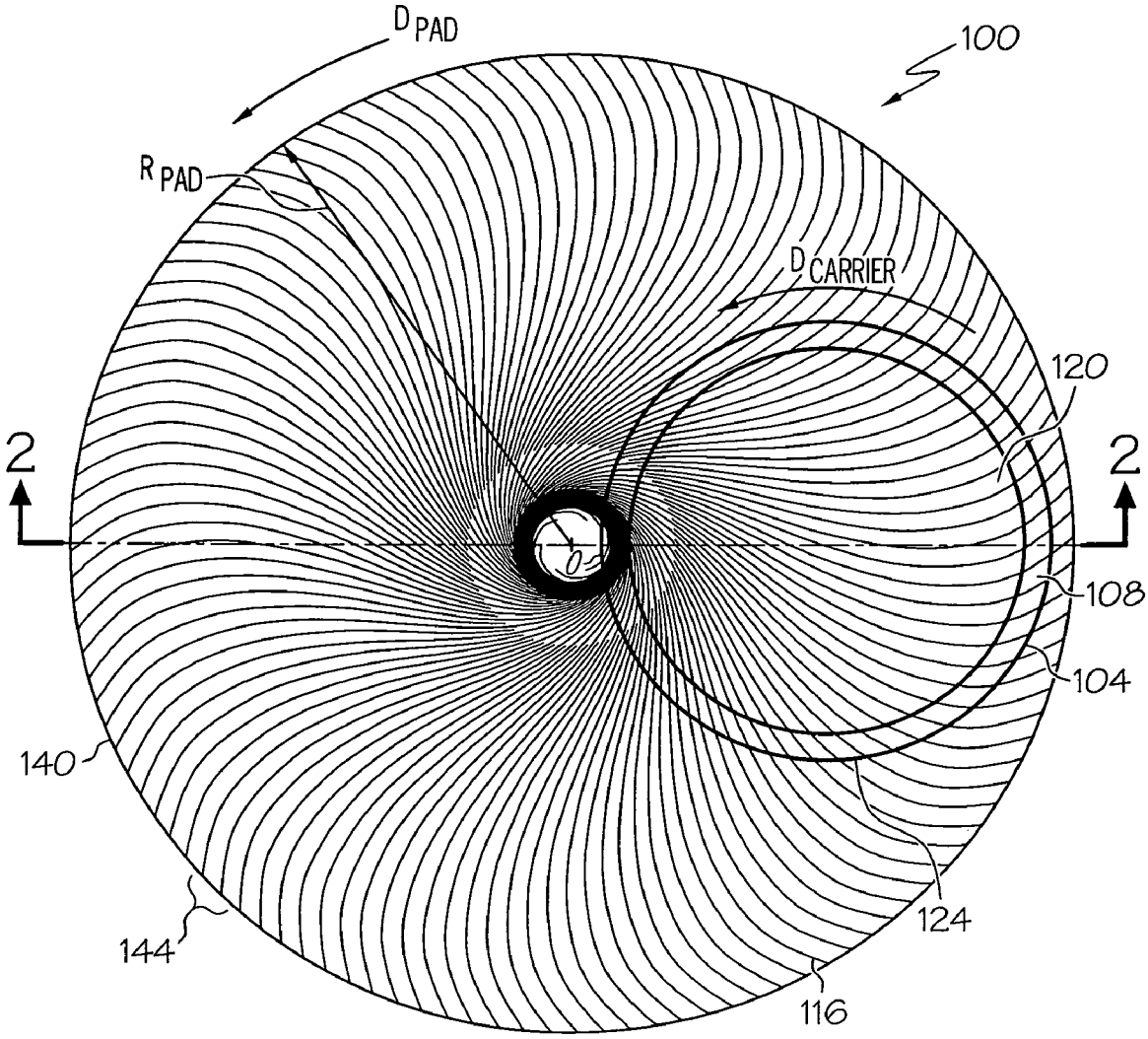
FIG. 1 is a schematic top view of a polishing pad made for use with a channel-free carrier ring in accordance with the method of the present invention.

Referring now to the drawings, FIG. 1 illustrates one embodiment of a polishing pad 100 made for use in accordance with the method of the present invention. As discussed below, polishing pad 100 is particularly designed in coordination with a corresponding respective carrier 104, e.g., a wafer carrier, having a channel-free carrier ring or fixture 108. For purposes of this specification, a channel-free carrier ring represents a structure that supports a substrate 120, but contains no passageways capable of transporting a polishing medium, such as a polishing slurry (not shown) from outside the carrier ring to within the carrier ring when the ring rests upon a flat surface. Typically, a carrier ring 108 will have a surface roughness $R_a$ of less than 100 μm. Advantageously, the carrier ring will have a surface roughness of less than 50 μm. Polishing pad 100 includes a plurality of pad grooves 116 configured to cooperate with channel-free carrier ring 108 so as to control flow of a polishing medium to a substrate 120 being polished, such as a semiconductor wafer, as the polishing pad 100 sweeps beneath carrier 104. In particular, the channel-free carrier ring 108 presses against the polishing pad 100 in a squeegee-like manner to impede flow between the channel-free carrier ring 108 and the polishing pad 100 and direct flow to the pad grooves 116. Since the pad grooves 116 traverse the channel-free carrier ring 108, they promote slurry flow to the substrate 120 at leading edge 124. In particular, this interaction of channel-free carrier ring 108 and pad grooves 116 occurs as polishing pad 100 and carrier 104 are rotated in predetermined directions $D_{Pad}$, $D_{Carrier}$, respectively.

Figure 2:
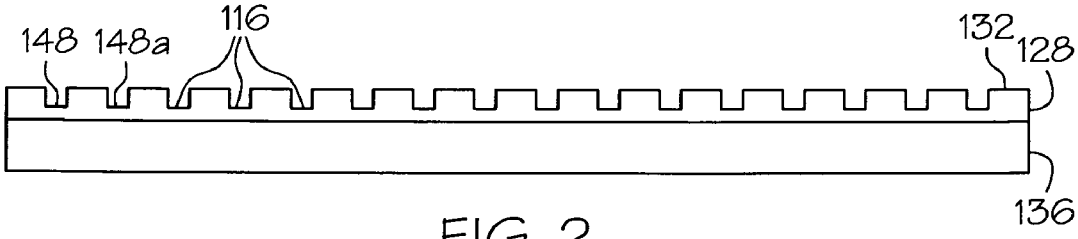
FIG. 2 is an exaggerated cross-sectional view of the polishing pad of FIG. 1 showing as taken along line 2-2 of FIG. 1, but illustrating carrier grooves that determine groove path in accordance with the method of the invention.

Referring to FIGS. 1 and 2, polishing pad 100 includes a polishing layer 128 having a polishing surface 132. In one example, polishing layer 128 may be supported by a backing layer or subpad 136, which may be formed integrally with polishing layer 128 or may be formed separately from polishing layer 128. Polishing pad 100 typically has a circular disk shape so that polishing surface 132 has a concentric center O and a circular outer periphery 140. The latter may be located a radial distance from O, as illustrated by radius $R_{Pad}$ of a particular length. At least a portion of the carrier-compatible groove 116 has a radial or curved-radial shape. For purposes of the specification, a radial or curved-radial shape is tangent to the radius $R_{Pad}$ of the polishing pad 100 in at least one location along the length of the radius $R_{Pad}$. Polishing layer 128 may be fabricated with any material suitable for polishing the article being polished, such as a semiconductor wafer, magnetic media article, e.g., a disk of a computer hard drive or an optic, e.g., a refractive lens, reflective lens, planar reflector or transparent planar article, among others. Examples of materials for polishing layer 128 include, for the sake of illustration and not limitation, various polymer plastics, such as a polyurethane, polybutadiene, polycarbonate and polymethylacrylate, among many others. In addition, these materials may or may not include porosity.

Pad grooves 116 may be arranged on polishing surface 132 in any of a number of suitable manners. In one example, pad grooves 116 may be the result of repeating a single groove shape circumferentially around concentric center O, e.g., using a constant angular pitch. In another example, which is shown in FIG. 1, pad grooves 116 may be arranged in at least one groove set 144 that is repeated circumferentially around concentric center O, e.g., at a constant angular pitch. In one example, groove set 144 comprises a plurality of individual pad grooves 116 that share a similar shape, but that extend different amounts. Advantageously, the individual pad grooves 116 are distinct with spacing between adjacent grooves. It is possible for these grooves to intersect with another groove, such as a circular, spiral or X-Y groove. Advantageously, however, these adjacent grooves do not intersect with other grooves in the wafer track. As will be appreciated, due to the circular nature of polishing pad 100, the spacing between multiple grooves that extend from proximate concentric center O of the pad near or to outer periphery 140 of the pad and that have a constant angular pitch naturally increases toward the outer periphery 140 of the pad. Consequently, to provide more uniform grooving, in some designs it is desirable to provide polishing pad 100 with more, but shorter, pad grooves 116 when the spacing exceeds a certain amount. It will be readily appreciated that several of groove sets 144 may be formed around concentric center O, as desired.

Further, and referring to FIG. 2 in addition to FIG. 1, each of the plurality of grooves 116 may be formed in polishing layer 132 in any suitable manner, such as by milling, molding, laser cutting, etc. Each of the plurality of pad grooves 116 may be formed with a cross-sectional shape 148 as desired to suit a particular set of design criteria. For example, each of the plurality of pad grooves 116 may have a triangular, square, rectangular 148*a* (FIG. 2) or U-shaped cross-sectional shape. Typically, square, rectangular and U-shaped cross-sections provide the best polishing performance. In another example, cross-sectional shape 148 of each pad groove 116 may vary along the length of the groove. In yet another example, cross-sectional shape 148 may vary from one pad groove 116 to another. In still another example, if multiple groove sets 144 are provided, cross-sectional shape 148 may vary from one groove set to another. Those having ordinary skill in the art will understand the wide range of cross-sectional shapes that a designer has in executing cross-sectional shape 148 of pad grooves 116.

Figure 3:
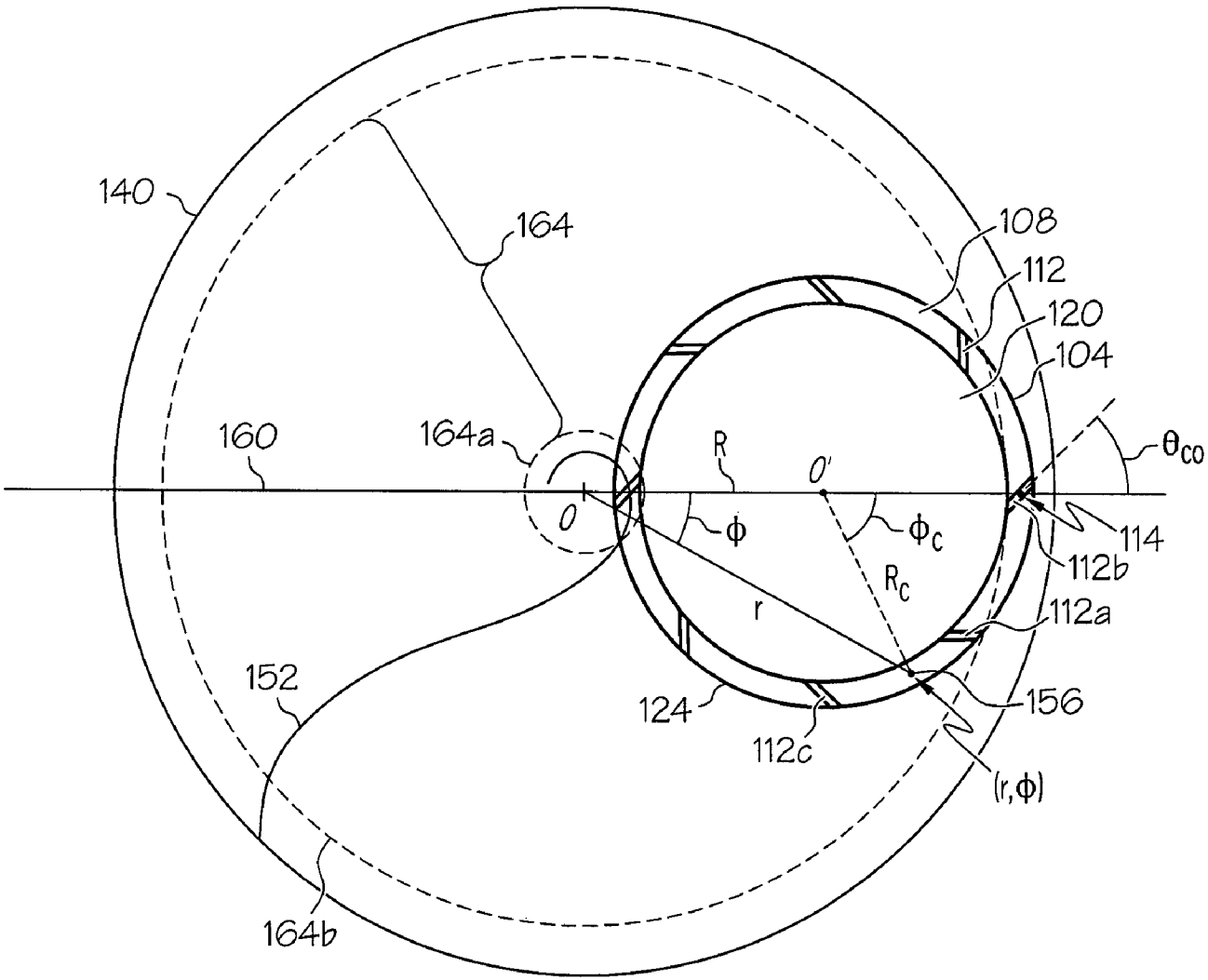
FIG. 3 is a schematic top view illustrating the geometry of the grooves of the polishing pad with a carrier having imaginary grooves used to generate the groove path for the method of the invention.

Referring now to FIGS. 1 to 3, each pad groove 116 (FIG. 1) is provided with a carrier-compatible groove shape 152. At a high level, carrier-compatible groove shape 152 may be defined by a plurality of points 156 that describe the direction, location and contour of each corresponding groove 116. Each of points 156 may be located by an angle $\phi$ formed between an axis, such as, for example, a horizontal axis 160, and a radius r projecting from concentric center O of polishing pad 100. In one example, carrier-compatible groove shape 152 may be defined over the entire, or substantially the entire, radial distance of polishing surface 132, i.e., $R_{Pad}$. In another example, carrier-compatible groove shape 152 may be defined in relation to the location of the article being polished, e.g., wafer 120. In yet another example, carrier-compatible groove shape 152 may be defined within a portion of a polishing track 164 on polishing surface 132 (FIG. 2), i.e., the region of the polishing surface that confronts wafer 120, or other article being polished, during polishing. Typically, the carrier-compatible groove occupies at least fifty percent of the wafer track as measured in a radial direction from the center O. Advantageously, the carrier compatible groove occupies at least two-thirds of the wafer track as measured in a radial direction from the center O. Most advantageously, the carrier compatible groove occupies the entire wafer track. Polishing track 164 may be defined by an inner boundary 164*a* and an outer boundary 164*b*. Those having ordinary skill in the art will readily appreciate that, although inner and outer boundaries 164*a*, 164*b* are largely circular, these boundaries may be undulated in the case of a polisher that imparts an orbital or oscillatory motion to the polished article or polishing pad 100.

Carrier-compatible groove shape 152 is defined as a function of three geometric parameters. The first parameter is the distance R between concentric center O of polishing pad 100 and rotational center O' of substrate 120 being polished. In the case where carrier 104 oscillates in a plane perpendicular to its axis of rotation, the distance R is a periodic function of time and the value of R used to determine carrier-compatible groove shape 152 may be the minimum, the maximum, or an intermediate value; preferably the time-average value of R is used. The second parameter is the radius $R_c$ of carrier 104. Typically, carrier radius $R_c$ will denote the outer radius of carrier ring 108 as measured from rotational center O'. Those having ordinary skill in the art will appreciate, however, that carrier radius $R_c$ may alternatively denote a radial distance from rotational center O' to another location on carrier ring 108, such as, for example, the mid-width of carrier ring 108 or the inner radius of carrier ring 108, as illustrated in FIG. 3. The third parameter is the angle $\theta_{c0}$ of imaginary carrier grooves 112. Imaginary carrier grooves 112 are a geometric construct used only to define the carrier-compatible groove shape 152 in polishing pad 100, but are not actually present in carrier ring 108 when used in accordance with the present invention. Imaginary carrier grooves 112 may be considered to be oriented on carrier ring 108 in a manner that forms a local angle $\theta_c$ with an axis, such as, for example, horizontal axis 160. In this case, wherein imaginary carrier grooves 112 are oriented as shown, local angle $\theta_c$ of imaginary carrier groove 112*a* is 0°, local angle $\theta_c$ of imaginary carrier groove 112*b* is 45° and local angle $\theta_c$ of imaginary carrier groove 112*c* is −45°. Those skilled in the art will readily recognize how to determine local angle $\theta_c$ for the remaining ones of imaginary carrier grooves 112 shown. Local angle $\theta_c$ of imaginary carrier grooves of alternative carrier rings having alternative imaginary carrier groove orientations can readily be determined in the same manner. The base local angle $\theta_{c0}$ used to determine carrier-compatible groove shape 152 is the angle formed at the intersection point 114 where an imaginary carrier groove 112 crosses horizontal axis 160 at a distance corresponding to carrier radius $R_c$. As defined, base local angle $\theta_{c0}$ may be positive, negative, or zero. As the carrier ring 108 and polishing pad 100 rotate, each imaginary carrier groove 112 advantageously aligns with various ones of pad grooves 116 at multiple locations adjacent the leading edge of the wafer 120. For example, the imaginary carrier grooves 112 may align with the pad grooves 116 adjacent the leading edge of the wafer 120 at several distinct locations within the wafer track 164 at different points in time. When both the polishing pad 100 and carrier ring 108 rotate in a counterclockwise direction, the instantaneous point of alignment between a given one of pad grooves 116 and sequential imaginary carrier grooves 112 will advantageously initiate near concentric center O, migrate outwardly across the wafer track 164 and then approach the periphery 140. Similarly, when both the polishing pad 100 and carrier ring 108 rotate in a clockwise direction, the instantaneous point of alignment between a given one of pad grooves 116 and sequential imaginary carrier grooves 112 will advantageously initiate near concentric center center O, migrate outwardly across the wafer track 164 and then approach the periphery 140.

Carrier-compatible groove shape 152 is well-defined everywhere within the width of polishing track 164, that is, at any radius equal to or greater than the radius of inner boundary 164*a* and less than or equal to the radius of outer boundary 164*b*. Inner boundary 164*a* may be defined by the radius $r=R-R_C$ drawn from concentric center O where r and R are time-averaged values if carrier 104 oscillates and fixed values otherwise. Outer boundary 164*b* may be defined by the radius $r=R+R_C$ drawn from concentric center O where r and R are time-averaged values if carrier 104 oscillates and fixed values otherwise. The values of r drawn from concentric center O which define carrier-compatible groove shape 152 thus span the interval of radius beginning at $(R-R_C)$ and ending at $(R+R_C)$. Outside this interval of radius, that is at values of r less than $(R-R_C)$ or greater than $(R+R_C)$, pad grooves 116 preferably follow a trajectory obtained by extrapolating carrier-compatible groove shape 152 at a slope equal or similar to the slope at the corresponding nearer boundary of polishing track 164.

Further, each point 156 along the portion, or whole, of carrier-compatible groove shape 152 may also be described by a carrier angle $\phi_c$ measured with respect to the rotational center O' of wafer carrier 104 located on horizontal axis 160, and subtended by the carrier radius $R_c$. A given point 156 may thus be located in terms of global polar coordinates $(r, \phi)$ referenced to concentric center O or in terms of local polar coordinates $(R_c, \phi_c)$ referenced to rotational center O'. From this geometric equivalence, it is possible to develop the following equation for the trajectory of carrier-compatible grooves that provide an improvement in polishing performance.

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c} \frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$.

Preferably the polishing occurs with the carrier fixture or ring 108 and polishing pad 100 rotating in the same direction. For instances where $\phi_c(r)$ is negative, both polishing pad 100 and carrier ring 108 rotate in a counterclockwise direction when viewed from above polishing surface 132. For instances where $\phi_c(r)$ is positive, both polishing pad 100 and carrier ring 108 rotate in a clockwise direction when viewed from above polishing surface 132. Advantageously, the polishing occurs with the high-rate groove path being within twenty percent of the above groove equation with a $\theta_{c0}$ of −90 to 90 degrees. For the purposes of this specification, within twenty percent means that the value of the global angle $\phi$ of the groove path at a given radius r referenced to concentric center O is between 0.8 and 1.2 times the value of the global angle $\phi$ computed using the above equation at the same radius r, and within ten percent means that the value of the global angle $\phi$ of the groove path at a given radius r referenced to concentric center O is between 0.9 and 1.1 times the value of the global angle $\phi$ computed using the above equation at the same radius r.

Most advantageously, the polishing occurs with the high-rate groove path within ten percent of the above groove equation with a $\theta_{c0}$ of −30 to 90 degrees. Furthermore, advantageously at least fifty percent of each high-rate groove path remains within twenty percent of the high-rate groove equation. For purposes of the specification the percent of the high-rate groove path that remains within the equation refers to the radial percentage as measured from the concentric center O to the outer periphery 140. Furthermore, most advantageously at least fifty percent of each high-rate groove path remains within ten percent of the high-rate groove equation. More advantageously, the polishing occurs with the high-rate path being within twenty percent of the groove equation with a $\theta_{c0}$ of 0 to 90 degrees. Most advantageously, the polishing occurs with the high-rate path being within twenty percent of the groove equation with a $\theta_{c0}$ of 30 to 60 degrees, such as 40 degrees, 45 degrees or 47.5 degrees. In particular, polishing has demonstrated excellent results with the high-rate path being within twenty percent of the groove equation with a $\theta_{c0}$ of 40 to 50 degrees.

Figure 4:
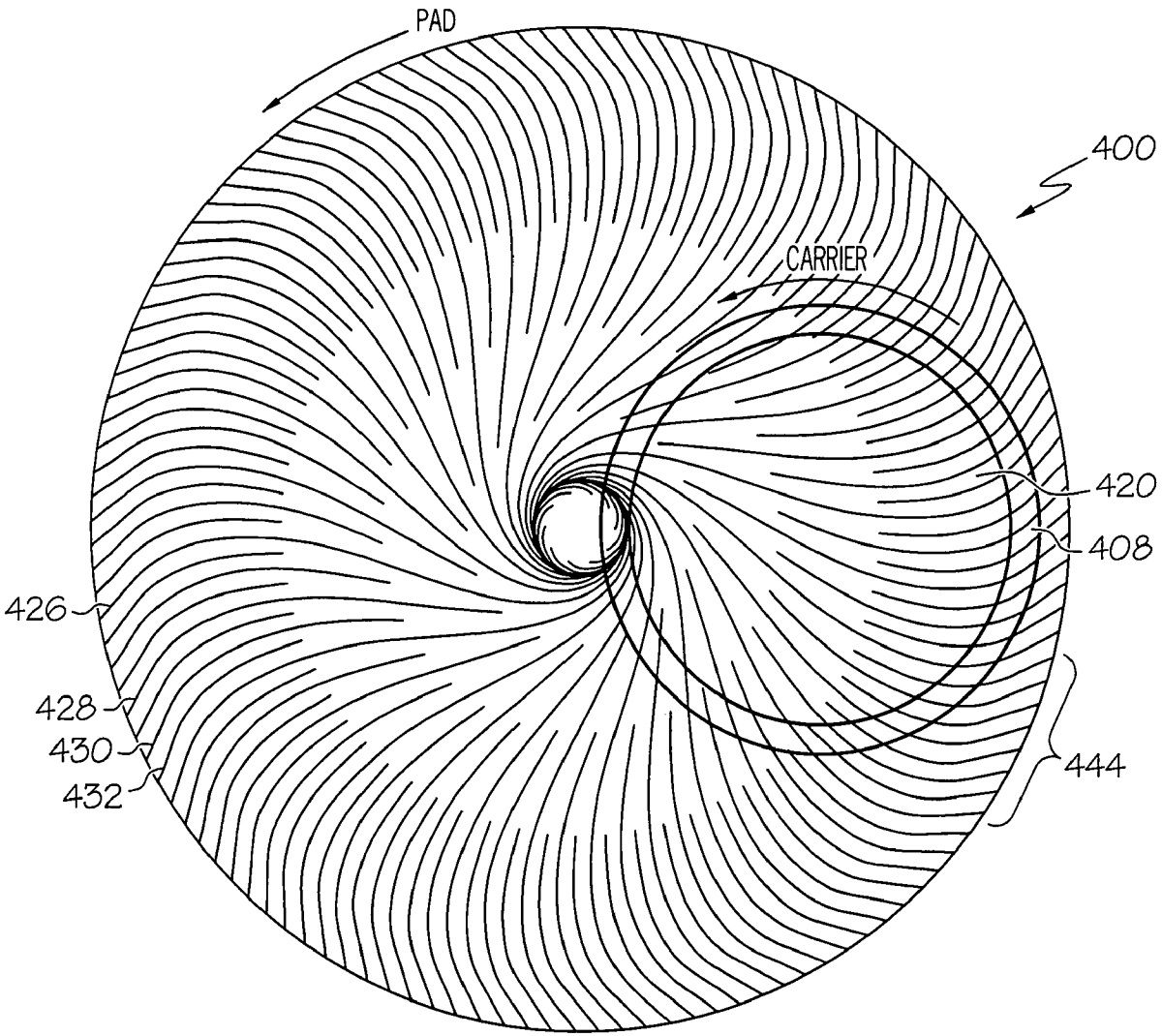
FIG. 4 is a schematic top view of an alternative polishing pad having grooves with varied lengths made for use with the method of the present invention.
Figure 5:
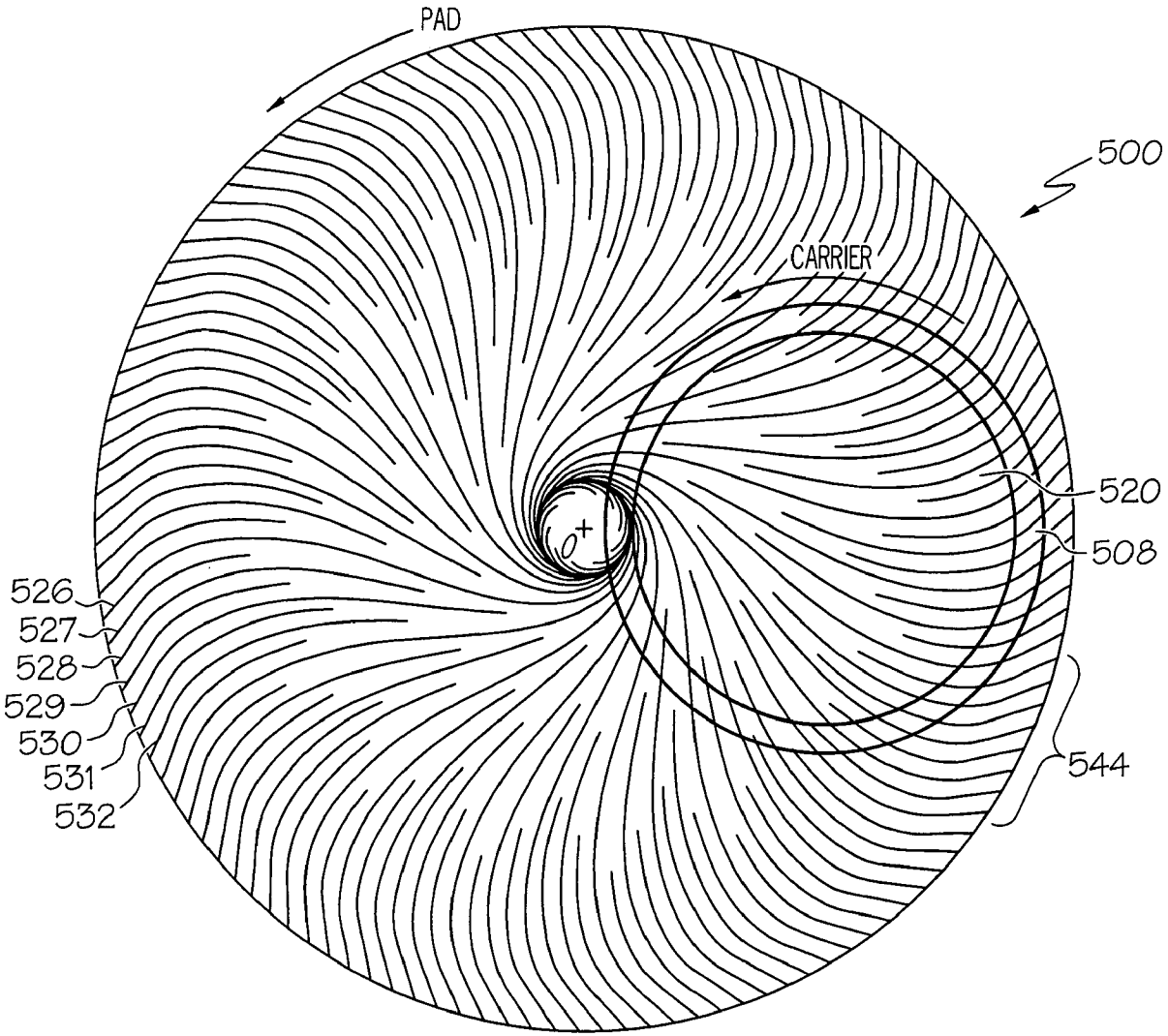
FIG. 5 is a schematic top view of an alternative polishing pad having grooves with varied and staggered lengths made for use with the method of the present invention.
Figure 6:
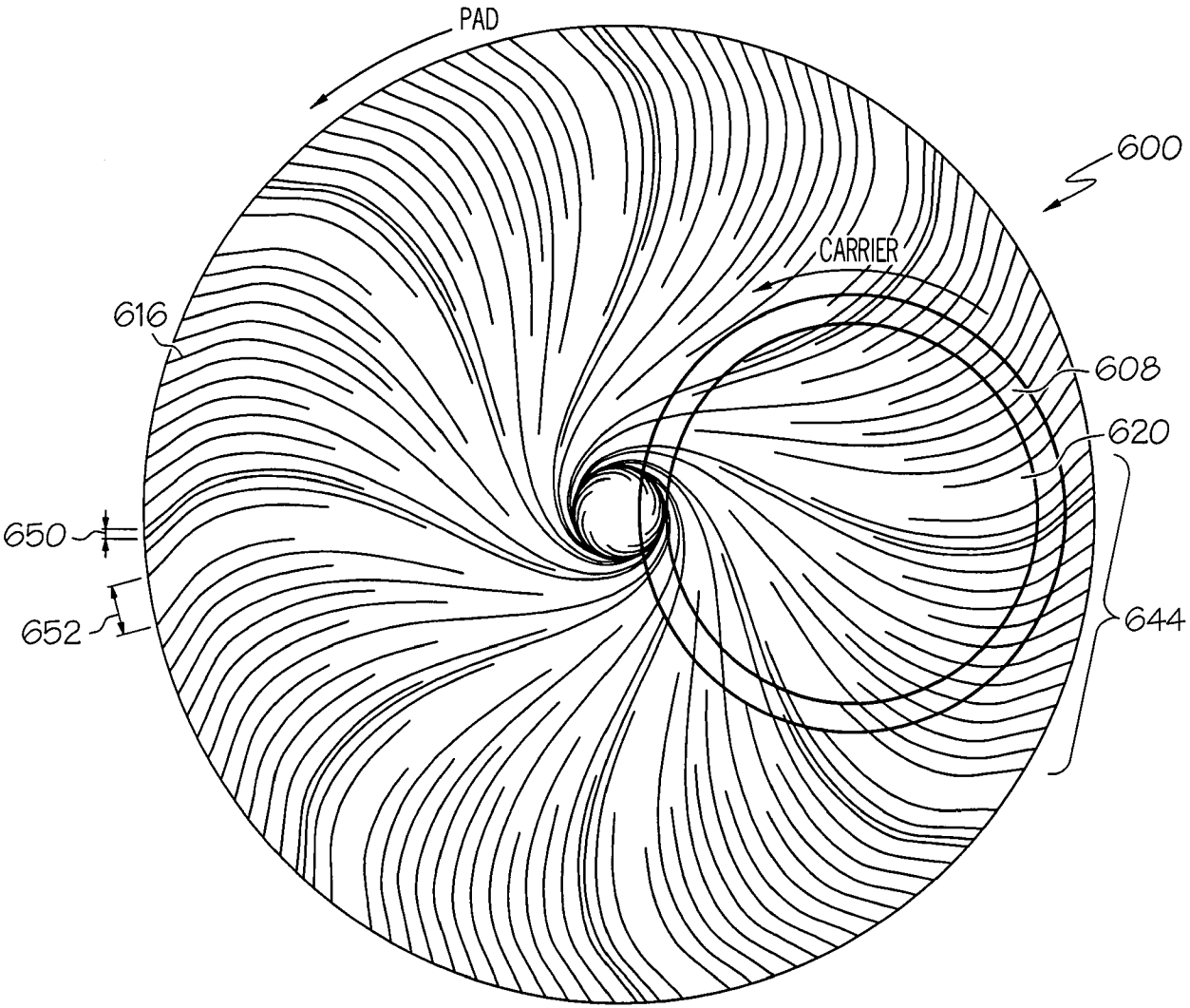
FIG. 6 is a schematic top view of an alternative polishing pad having grooves with varied and staggered lengths in combination with uneven spacing made for use with the method of the present invention.

FIGS. 4 to 6 illustrate details of various exemplary pad grooves 116 that function with channel-free carrier rings 408 to direct polishing media to wafer 420. Referring to FIG. 4, polishing pad 400 includes curved-radial grooves 426, 428, 430 and 432 organized into repeating groove sets 444. Each groove set 444 contains (1) 426, (1) 428, (2) 430 and (4) 432 curved-radial grooves that have uneven starting positions as measured from the center of the polishing pad O (FIG. 3). Collectively, these grooves function to balance the polishing pad's groove to surface area ratio across the wafer track. Grooves 426 extend from the outer periphery of the polishing pad 400 to a location within the inner boundary of the wafer track (not shown). Grooves 428 extend from the outer periphery of the polishing pad 400 to a location within adjacent the inner boundary of the wafer track. Grooves 430 extend from the outer periphery of the polishing pad 400 to a location within a center region of the wafer track. Grooves 432 extend from the outer periphery of the polishing pad 400 to a location within the outer boundary of the wafer track.

Polishing pad 500 of FIG. 5 includes curved-radial grooves 526 to 532 organized into repeating groove sets 544. Each groove set 544 contains (1) 526, (1) 527, (1) 528, (2) 529, (1) 530, (1) 531 and (1) 532 curved-radial grooves. These grooves collectively interact with carrier ring 508 to increase polishing removal rate of wafer 520. The polishing pad 500 has a center O and the polishing occurs with multiple grooves that have a high-rate path that initiates with staggered radii from the center O. Collectively, these grooves function to balance the polishing pad's groove to surface area ratio across the wafer track. In addition, each groove within the groove set has a staggered transition point for initiating the grooves. For example, these grooves extend from a starting point inside the wafer track (not shown) to a position within the outer boundary of the wafer track.

Polishing pad 600 of FIG. 6 includes curved-radial grooves 616 organized into repeating groove sets 644. These groove sets collectively interact with carrier ring 608 to increase polishing removal rate of wafer 620. Each groove set 644 contains curved-radial grooves with uneven angular spacing; and the polishing occurs with uneven angular spacing between ones of the multiple grooves 616 having a high-rate path. For example, groove set 644 includes angular groove spacings that range from a tight angular spacing 650 to wide angular spacing 652. In particular, each groove set may contain only uneven angular-spaced grooves or a combination of even-angular spaced and uneven-angular spaced grooves. In addition, each groove set 644 contains grooves with uneven radial spacing, the grooves having varied transition or starting points. For example, these grooves extend from a starting point inside the wafer track (not shown) to a position within the outer boundary of the wafer track. Collectively, these grooves function to balance the polishing pad's groove to surface area ratio across the wafer track and can reduce the within-wafer-non-uniformity (WIWNU) and improve the removal rate of a CMP process.

Figure 7:
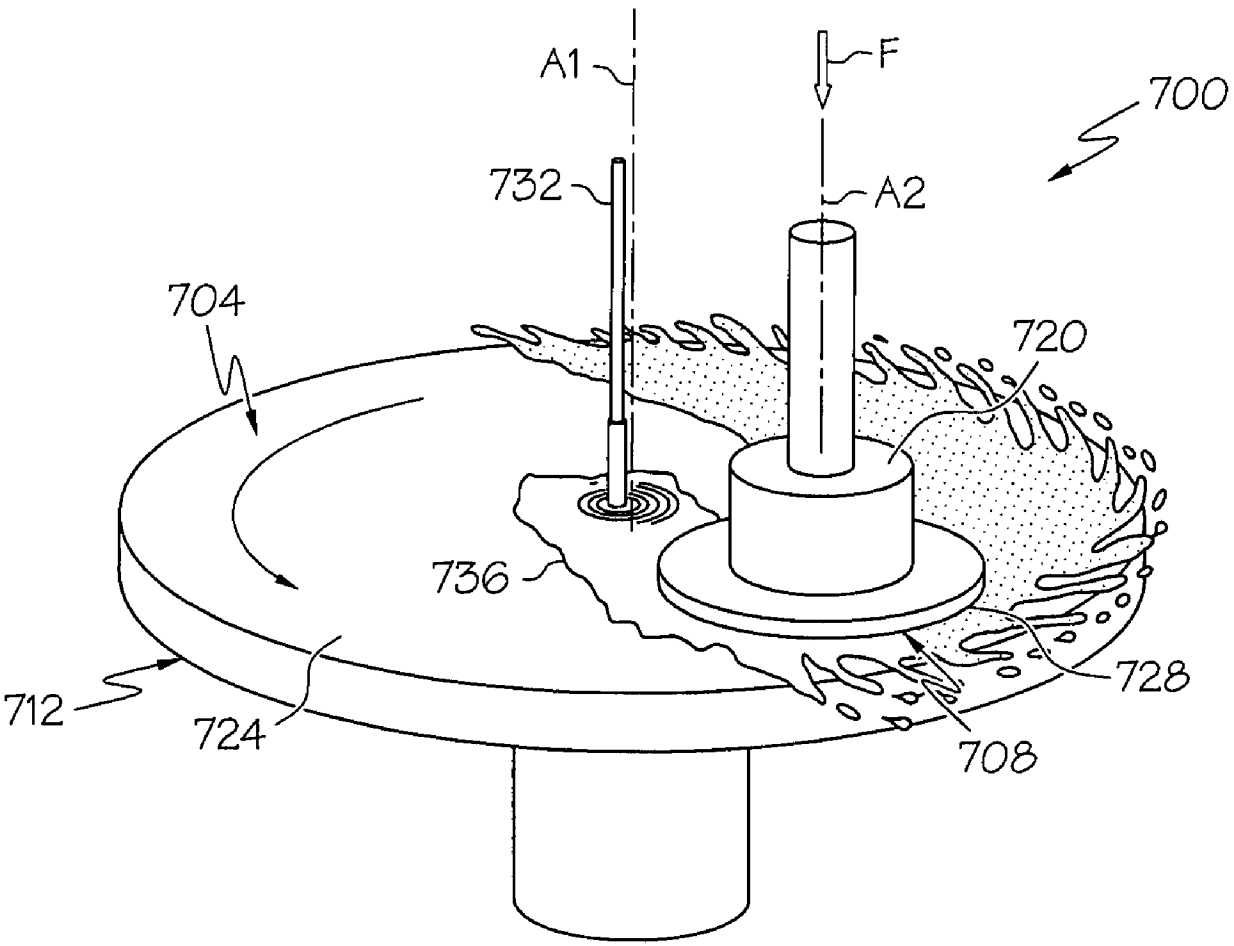
FIG. 7 is a schematic diagram of a polishing system in accordance with the present invention.

FIG. 7 illustrates a polisher 700 suitable for use with a polishing pad 704, which may be one of polishing pads 100, 400, 500 and 600 of FIGS. 1-6 or other polishing pads of the present disclosure, for polishing an article, such as a wafer 708. Polisher 700 may include a platen 712 on which polishing pad 704 is mounted. Platen 712 is rotatable about a rotational axis A1 by a platen driver (not shown). Polisher 700 may further include a wafer carrier 720 that is rotatable about a rotational axis A2 parallel to, and spaced from, rotational axis A1 of platen 712 and supports wafer 708 during polishing. Wafer carrier 720 may feature a gimbaled linkage (not shown) that allows wafer 708 to assume an aspect very slightly non-parallel to the polishing surface 724 of polishing pad 704, in which case rotational axes A1, A2 may be very slightly askew relative to each other. Wafer 708 includes a polished surface 728 that faces polishing surface 724 and is planarized during polishing. Wafer carrier 720 may be supported by a carrier support assembly (not shown) adapted to rotate wafer 708 and provide a downward force F to press polished surface 728 against polishing pad 704 so that a desired pressure exists between the polished surface and the pad during polishing. Polisher 700 may also include a polishing medium inlet 732 for supplying a polishing medium 736 to polishing surface 724.

As those skilled in the art will appreciate, polisher 700 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 708 and polishing pad 704; (2) controllers and selectors for varying the rate and location of delivery of polishing medium 736 to the pad; (3) controllers and selectors for controlling the magnitude of force F applied between the wafer and polishing pad, and (4) controllers, actuators and selectors for controlling the location of rotational axis A2 of the wafer relative to rotational axis A1 of the pad, among others. Those skilled in the art will understand how these components are constructed and implemented such that a detailed explanation of them is not necessary for those skilled in the art to understand and practice the present invention.

During polishing, polishing pad 704 and wafer 708 are rotated about their respective rotational axes A1, A2 and polishing medium 736 is dispensed from polishing medium inlet 732 onto the rotating polishing pad. Polishing medium 736 spreads out over polishing surface 724, including the gap between wafer 708 and polishing pad 704. Polishing pad 704 and wafer 708 are typically, but not necessarily, rotated at selected speeds of 0.1 rpm to 750 rpm. Force F is typically, but not necessarily, of a magnitude selected to induce a desired pressure of 0.1 psi to 15 psi (6.9 to 103 kPa) between wafer 708 and polishing pad 704. The interaction of the pad grooves with the carrier ring can result in a substantial increase in substrate removal rate and an improvement in wafer-to-wafer non-uniformity.

EXAMPLE

In this example, 77.5-cm diameter IC1000 hard polyurethane polishing pads manufactured by Rohm and Haas Electronic Materials CMP Technologies, Newark, Del., USA with either conventional concentric circular grooves or high-rate grooves according to the present invention demonstrate the efficacy of the high-rate grooves to raise removal rate when used together with a carrier ring having no channels. The concentric circular grooves were machined to a depth of 0.76 mm and a width of 0.51 mm on a constant pitch of 3.1 mm; the high-rate grooves were machined to a depth of 0.76 mm and a width of 0.76 mm with a pattern and curvature as dictated by the equation for the high-rate path applied across the full wafer track. Tungsten 300-mm blanket wafers were polished using each groove type together with a carrier ring having no channels at a downforce of 26.6 kPa, a pad rotation rate of 120 rpm, a carrier rotation rate of 113 rpm, and slurry flow rates of 200 and 120 ml/min., producing the results of Table 1. Average values refer to the arithmetic average of the results obtained across the four individual wafers in each set.

| Tungsten Blanket Wafer Number | Slurry Flow Rate, ml/min | Removal Rate, Å/min using Concentric Circular Groove | Removal Rate, Å/min using High-Rate Groove | Increase in Removal Rate using High-Rate Groove, % |
|---|---|---|---|---|
| 1 | 200 | 2042 | 3319 | 63 |
| 2 | 200 | 2096 | 3345 | 60 |
| 3 | 200 | 2127 | 3420 | 61 |
| 4 | 200 | 2189 | 3438 | 57 |
| Average | 200 | 2113 | 3380 | 60 |
| WTWNU, % | 200 | 2.9 | 1.7 | |
| 1 | 120 | 1972 | 3721 | 89 |
| 2 | 120 | 2009 | 3656 | 82 |
| 3 | 120 | 2014 | 3688 | 83 |
| 4 | 120 | 2018 | 3683 | 83 |
| Average | 120 | 2003 | 3687 | 84 |
| WTWNU, % | 120 | 1.1 | 0.7 | |

Relative to the conventional concentric circular groove, the high-rate groove increased removal rate on tungsten blanket wafers by an average of 60% at a slurry flow rate of 200 ml/min and by an average of 84% at a slurry flow rate of 120 ml/min when both groove types were used with a carrier ring having no channels. In addition, the wafer-to-wafer non-uniformity (WTWNU) of removal rates was reduced from 2.9% to 1.7% at a slurry flow rate of 200 ml/min and from 1.1% to 0.7% at a slurry flow rate of 120 ml/min.

The invention claimed is:

1. A method for polishing at least one of a magnetic, optical and semiconductor substrate in the presence of a polishing medium with a polishing pad, the substrate being fixed within a carrier fixture, the carrier fixture having a channel-free surface, the method comprising:

a) securing the substrate in the carrier fixture with the channel-free surface adjacent and parallel to a polishing surface of the polishing pad, the polishing pad having multiple grooves, the multiple grooves having a high-rate path, at least fifty percent of the high-rate path being within twenty percent of a groove trajectory $\phi(r)$ in polar coordinates referenced to a concentric center of the polishing pad and defined in terms of (1) distance R between the concentric center of the polishing pad and the rotational center of the substrate being polished, (2) radius $R_c$ of the carrier fixture, and (3) local angle $\theta_{c0}$ of imaginary grooves in the carrier fixture, as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ b) applying polishing medium to the polishing pad adjacent the carrier fixture; and c) rotating the polishing pad and carrier fixture to polish the substrate with the polishing pad and the polishing medium wherein the channel-free surface of the carrier fixture presses against the polishing pad to impede flow of the polishing medium into the substrate and the high-rate groove paths traverse the carrier fixture to promote flow of the polishing medium to the substrate.

2. The method of claim 1 wherein the polishing pad has a center and the polishing occurs with multiple grooves that initiate with staggered radii from the center.

3. The method of claim 1 wherein the rotating occurs with the polishing pad rotating in a counterclockwise direction for $\phi_c(r)$ being negative or in a clockwise direction for $\phi_c(r)$ being positive.

4. The method of claim 1 wherein the polishing occurs with the high-rate path being within twenty percent of the groove trajectory with a $\theta_{c0}$ of 0 to 90 degrees.

5. A method for polishing at least one of a magnetic, optical and semiconductor substrate in the presence of a polishing medium with a polishing pad, the substrate being fixed within a carrier fixture, the carrier fixture having a channel-free surface, the method comprising:

a) securing the substrate in the carrier fixture with the channel-free surface adjacent and parallel to a polishing surface of the polishing pad, the polishing pad having multiple grooves, the multiple grooves having a high-rate path, at least fifty percent of the high-rate path being within twenty percent of a groove trajectory $\phi(r)$ in polar coordinates referenced to a concentric center of the polishing pad and defined in terms of (1) distance R between the concentric center of the polishing pad and the rotational center of the substrate being polished, (2) radius $R_c$ of the carrier fixture, and (3) local angle $\theta_{c0}$ of imaginary grooves in the carrier fixture, as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ b) applying polishing medium to the polishing pad adjacent the carrier fixture; and c) rotating the polishing pad and carrier fixture in the same direction to polish the substrate with the polishing pad and the polishing medium wherein the channel-free surface of the carrier fixture presses against the polishing pad to impede flow of the polishing medium into the substrate and the high-rate groove paths traverse the carrier fixture to promote flow of the polishing medium to the substrate.

6. The method of claim 5 wherein the polishing pad has a center and the polishing occurs with multiple grooves that initiate with staggered radii from the center.

7. The method of claim 5 wherein the rotating occurs with the polishing pad rotating in a counterclockwise direction for $\phi_c(r)$ being negative or in a clockwise direction for $\phi_c(r)$ being positive.

8. The method of claim 5 wherein the polishing occurs with uneven angular spacing between ones of the multiple grooves having a high-rate path.

9. The method of claim 5 wherein the polishing occurs with the high-rate path being within twenty percent of the groove trajectory with a $\theta_{c0}$ of 30 to 60 degrees.

10. The method of claim 5 wherein the polishing occurs with the high-rate path being within ten percent of the groove trajectory with a $\theta_{c0}$ at 40 to 50 degrees.

* * * * *